US008628212B2

(12) United States Patent
Kluś

(10) Patent No.: US 8,628,212 B2
(45) Date of Patent: Jan. 14, 2014

(54) CONDUCTIVE END CAPS FOR LED-BASED LINEAR LIGHTING APPARATUS

(76) Inventor: Sylwester Kluś, Kamionka (PL)

( * ) Notice: Subject to any disclaimer, the term of this patent is extended or adjusted under 35 U.S.C. 154(b) by 347 days.

(21) Appl. No.: 13/046,699

(22) Filed: Mar. 12, 2011

(65) Prior Publication Data

US 2011/0164419 A1 Jul. 7, 2011

Related U.S. Application Data

(63) Continuation-in-part of application No. 12/617,326, filed on Nov. 12, 2009, now Pat. No. 8,267,540.

(51) Int. Cl.
*F21V 21/00* (2006.01)
*H01R 33/00* (2006.01)

(52) U.S. Cl.
USPC ..... 362/217.14; 362/217.01; 362/647; 362/652; 362/249.02; 362/391

(58) Field of Classification Search
USPC ..... 362/217.14, 249.02, 647, 652, 657, 362/658, 217.01, 217.1, 217.12, 217.17, 362/153, 223; 439/225–227, 232, 233, 135, 439/136, 296, 299, 300, 338, 339, 345, 355, 439/356, 359, 360, 658, 659, 660, 661; 174/74 R, 74 A, 79
See application file for complete search history.

(56) References Cited

U.S. PATENT DOCUMENTS

| | | | | |
|---|---|---|---|---|
| 3,436,716 | A * | 4/1969 | Amis, Jr. et al. | 439/232 |
| 3,989,335 | A * | 11/1976 | Belokin, Jr. | 439/225 |
| 7,159,997 | B2 * | 1/2007 | Reo et al. | 362/240 |
| 7,857,482 | B2 * | 12/2010 | Reo et al. | 362/225 |

* cited by examiner

*Primary Examiner* — Thomas Sember
(74) *Attorney, Agent, or Firm* — Mark Terry

(57) ABSTRACT

A conductive end cap for a linear lighting apparatus is disclosed. The first embodiment of the present invention comprises, among other things, an insulating cap for one end of the linear lighting apparatus, the cap including a first orifice extending from the exterior side of the cap to the interior side of the cap and a conducting shaft extending through the first orifice and protruding from the exterior side of the cap, such that the shaft may rotate about its central axis within the first orifice. The conductive end cap also includes a second orifice extending perpendicularly through a portion of the shaft for accepting a conductive line and a static conductive element protruding from the interior side of the cap so as to provide a conductive terminal for a lighting element located within the linear lighting apparatus.

18 Claims, 19 Drawing Sheets

CONDUCTIVE END CAPS FOR LED-BASED LINEAR LIGHTING APPARATUS

CROSS-REFERENCE TO RELATED APPLICATIONS

This patent application is a continuation in part of patent application Ser. No. 12/617,326 filed on Nov. 12, 2009 now U.S. Pat. No. 8,267,540. The subject matter of patent application Ser. No. 12/617,326 is hereby incorporated by reference in its entirety.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

FIELD OF THE INVENTION

This invention relates to the field of lighting, and more particularly to the field of LED-based special-purpose lighting.

BACKGROUND OF THE INVENTION

Various types of linear lighting apparatuses exist in the lighting industry today. Many of the latest lighting apparatuses use-light-emitting diodes ("LEDs") as light sources. LEDs are individual point light sources that deliver a singular beam of light. Conventional linear lighting apparatuses that use LEDs are usually constructed for particular purposes. For example, the lighting apparatuses may be constructed for use on ceilings for lighting a room, for use within cabinets to illuminate the contents of a drawer or for use on an exterior wall for lighting a sign.

U.S. Pat. No. 6,361,186, for example, discloses a linear lighting apparatus using LEDs wherein the lighting apparatus is constructed generally for use on walls as commercial signage. U.S. Pat. No. 6,682,205 also discloses an LED-based linear lighting apparatus constructed generally for use on walls as signage. U.S. Pat. No. 6,585,393 discloses an LED linear lighting apparatus constructed generally for use as under-cabinet lighting for the home. Lastly, U.S. Pat. Pub. No. 2006/0146531 discloses a linear lighting apparatus using LEDs wherein the lighting apparatus is constructed generally for lighting billboards or the facade of a building.

One of the problems with currently-available linear lighting apparatuses is the mechanism by which current is provided to the apparatus. Typically, an external wire carrying current is introduced into the interior of the linear lighting apparatus to power the light element, such as an LED strip. In this embodiment, the wire must be permanently coupled or soldered to the LED element. This arrangement is disadvantageous since it makes the removal or readjustment of the linear lighting apparatus more difficult and time-consuming. That is, if the linear lighting apparatus must be moved a short distance or simply opened for maintenance, the permanent coupling or soldering must be removed, which can waste time and cause damage to the apparatus, especially the sensitive LED elements within the apparatus. Further, since a static wire is permanently coupled to an LED strip within the linear lighting apparatus, frequent rotation of the linear lighting apparatus about its central axis over long periods of time can lead to a break or short circuit in the wire. Moreover, this configuration reduces the range of motion of the linear lighting apparatus, since the apparatus includes a soldered connection to a static wire.

Another problem with conventional linear lighting apparatuses is the complexity and time intensive nature of installing them. Typically, one or more linear lighting apparatuses of desired length are produced for a project and shipped to the installation site. Thereafter, the installation includes running wire (carrying current) to the linear lighting apparatuses, introducing the wire into the interior of the linear lighting apparatuses and permanently coupling or soldering an end of the wire to the LED strip within the apparatus. Consequently, conventional installation can be a time-consuming and tedious task that requires various tools and includes a risk of injury to the installer and a potential for damage to the equipment being installed. This is disadvantageous as it increases the time and cost of installation of the linear lighting apparatuses. The current installation process is further disadvantageous since it includes providing access to the interior of the linear lighting apparatus, which includes sensitive LED elements that can easily be damaged.

Therefore, there is a need to traverse the deficiencies in the art and more particularly there is a need for a more efficient and robust method for providing current to a linear lighting apparatus.

SUMMARY OF THE INVENTION

Briefly, in accordance with a first embodiment of the present invention, a conductive end cap for a linear lighting apparatus is disclosed. The first embodiment of the present invention comprises, among other things, an insulating cap for one end of the linear lighting apparatus, the cap including a first orifice extending from the exterior side of the cap to the interior side of the cap and a conducting shaft extending through the first orifice and protruding from the exterior side of the cap, such that the shaft may rotate about its central axis within the first orifice. The conductive end cap also includes a second orifice extending perpendicularly through a portion of the shaft for accepting a conductive line and a static conductive element protruding from the interior side of the cap so as to provide a conductive terminal for a lighting element located within the linear lighting apparatus.

In accordance with a second embodiment of the present invention, a conductive end cap for a linear lighting apparatus includes an insulating cap for one end of the linear lighting apparatus, the cap including a first orifice extending from the exterior side of the cap to the interior side of the cap and a conducting tubular element located on the exterior side of the cap. The conductive end cap also includes a second orifice extending perpendicularly through the tubular element for accepting a conductive line and a first bolt threaded through the second end of the tubular element at least up to the second orifice, so as to create a friction fit for the conductive line in the second orifice of the tubular element. The conductive end cap also includes a conductive element protruding from the interior side of the cap so as to provide a conductive terminal for a lighting element located within the linear lighting apparatus and a second bolt extending through the hole in the conductive element, through the first orifice and threading through the first end of the tubular element, so as to conductively couple the conductive element and the tubular element.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings.

DETAILED DESCRIPTION

Figure 1:
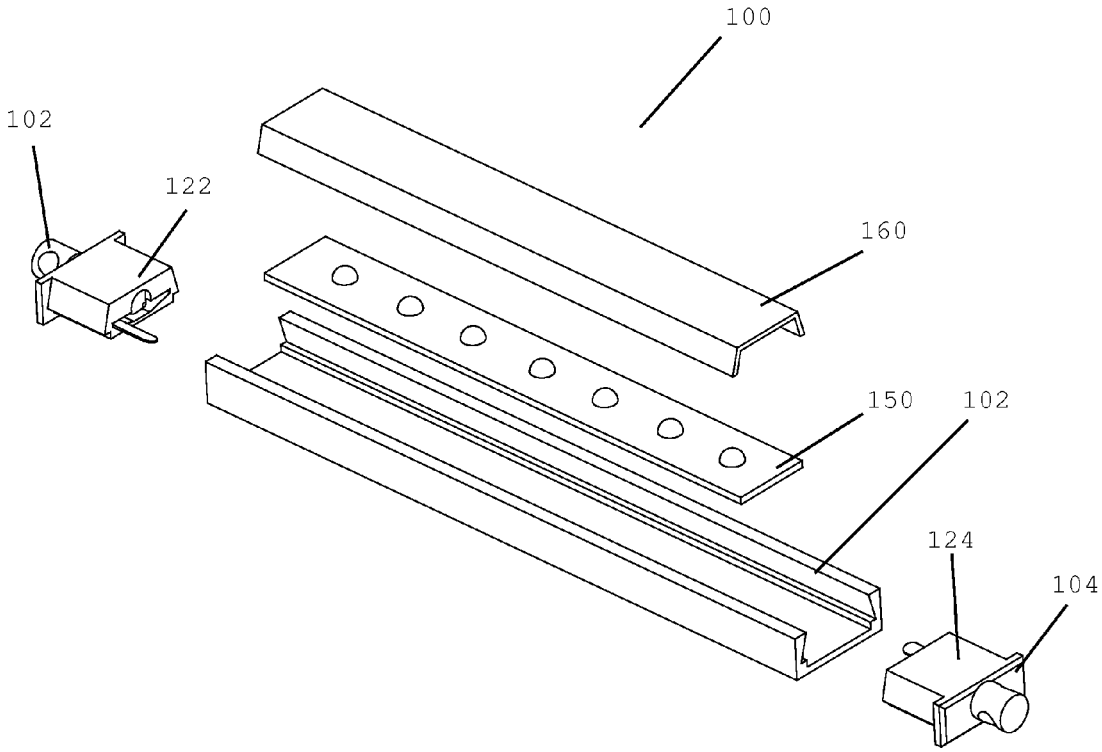
FIG. 1 shows a frontal perspective view of the special purpose LED-based linear lighting apparatus in a disassembled state, in accordance with one embodiment of the present invention.

It should be understood that these embodiments are only examples of the many advantageous uses of the innovative teachings herein. In general, statements made in the specification of the present application do not necessarily limit any of the various claimed inventions. Moreover, some statements may apply to some inventive features but not to others. In general, unless otherwise indicated, singular elements may be in the plural and vice versa with no loss of generality. In the drawing like numerals refer to like parts through several views.

The present invention, according to a preferred embodiment, overcomes problems with the prior art by providing a conductive end cap that both sufficiently caps or covers the cavity present in the endpoint of the linear lighting apparatus and acts as a conductive relay between the exterior and the interior of the linear lighting apparatus. The configuration of the present invention allows an external wire carrying current to power the LED strip within the linear lighting apparatus without having to introduce the wire into the interior of the linear lighting apparatus—the user need only couple the wire with a terminal on the exterior of the linear lighting apparatus. Linear lighting apparatuses can therefore be easily installed and just as easily uninstalled and moved to a new location or serviced. This is advantageous since it simplifies the assembly or construction of a system including the linear lighting apparatus, thereby decreasing the time and cost associated with installation. Further, the linear lighting apparatus is maintained in a sealed state during construction and when the linear lighting apparatus is disconnected from the wire and moved to another location. This is beneficial since the LED elements within the linear lighting apparatus are sensitive and prone to damage.

The present invention further provides a conductive terminal on the exterior of the linear lighting apparatus, wherein the conductive terminal includes a rotating swivel feature. This feature reduces or eliminates the chances that repeated rotation of the linear lighting apparatus about its central axis will cause a break or a short circuit in the wire carrying current to the apparatus. This feature is further advantageous since it allows the linear lighting apparatus a fuller range of motion, due to the lack of any restriction in movement associated with a soldered connection to a static wire.

Additionally, the present invention provides a conducting end cap apparatus that contains few components and moving parts. This is beneficial as it lowers the possibility of malfunctions and construction defects, as well as increases the average time to failure for the apparatus. The low number of constituent parts of the present invention also simplifies the fabrication process and lowers fabrication costs.

The present invention shall be described initially with reference to FIG. 1. FIG. 1 shows a frontal perspective view of the special purpose LED-based linear lighting apparatus 100 in a disassembled state, in accordance with one embodiment of the present invention.

The apparatus 100 is a linear lighting apparatus using LEDs with the intended function of special purpose lighting for floors, counters and other areas. Linear lighting apparatus 100 may be used as a low voltage linear floodlight luminaire for both indoor and outdoor applications. The apparatus 100 exudes light from LEDs through the open top area to provide illumination. The apparatus 100 may be constructed for placement into a floor, a wall, a corner, under a counter or the like. FIG. 1 shows that apparatus 100 comprises an elongated unit 102 of material having a substantially U-shaped cross-section. The unit 102 of apparatus 100 may comprises any of a variety of materials, including aluminum, various alloys, ceramic or plastic. Further, the apparatus 100 may be fabricated using any of a variety of processes, such as extrusion, injection molding, or metal working. In a preferred embodiment, the unit 102 of apparatus 100 comprises extruded aluminum. Unit 102 may be fabricated in a variety of predefined lengths, such as one meter lengths. In addition, unit 102 may be customizable in length.

The substantially U-shaped unit 102 includes a first sidewall, a second sidewall and a floor. FIG. 1 shows that an LED strip 150, such as a flexible printed circuit board (PCB) strip including a series of LEDs, can rest on the top surface of the floor. Strip 150 includes a plurality of LEDs mounted on it. In another embodiment of the present invention, strip 150 comprises a flexible tape with LEDs surface mounted on the tape.

Optical element 160 may include refractory materials such as an extruded refractory material. The present invention also supports the use of multiple optical elements. An exemplary material for element 160 may be an acrylic material, due to its excellent light transmission and UV light stability properties, or polymethyl methacrylate. However, any refractory material with increased light transmission efficiencies and/or UV light stability properties may be used for element 160 in accordance with the present invention. Further, optical material with various translucent qualities can be used for element 160. In operation, elements 160 provides a variety of optical functions such as refracting, reflecting, increasing light-transmission efficiency, directing light, collimating light, diffusing light and spreading light.

FIG. 1 further shows end caps 102 and 104. The end caps 102, 104 are used for capping or sealing the ends of apparatus 100 after assembly. Note that end cap 102 includes a protrusion 122 having the same shape as a portion of the orifice present in the anterior end of unit 102. Thus, the protrusion 122 can be inserted into the posterior end of unit 102 so as to create a friction fit with the unit 102. Likewise, end cap 104 includes a protrusion 124 having the same shape as a portion of the orifice present in the posterior end of unit 102 so that the protrusion 124 can be inserted into the anterior end of unit 102 so as to create a friction fit with the unit 102. Note also that both end caps 102, 104 include features for electric coupling to an electrical cord or wire so as to provide power to the LEDs 150. These features arc described more fully below.

Figure 2A:
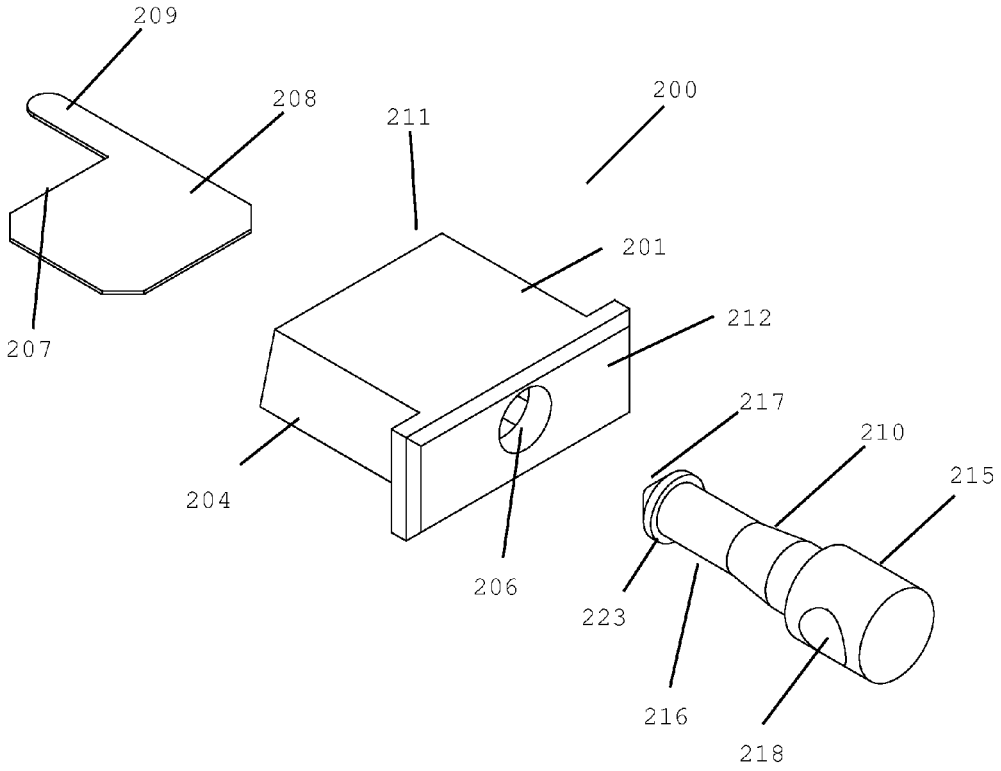
FIG. 2A shows a frontal perspective view of the first embodiment of the conductive end cap in a disassembled state, in accordance with one embodiment of the present invention.

A first embodiment of the present invention shall be described below with reference to FIGS. 2A-2J. FIG. 2A shows a frontal perspective view of the first embodiment of the conductive end cap 200 in a disassembled state, in accordance with one embodiment of the present invention. FIGS. 2A-2H shows an insulating cap 201 for insertion into one end of the linear lighting apparatus 100, the cap 201 having an interior side 211 that faces an interior of the linear lighting apparatus 100 and an exterior side 212 that remains exterior to the linear lighting apparatus 100. Note insulating cap 201 includes a portion 204 shaped to fit within a cavity in one end of the linear lighting apparatus 100 and to provide a friction fit with an interior of the cavity. Also note that the exterior side 212 of the insulating cap is larger than the portion 204 and the cavity in one end of the linear lighting apparatus 100, thereby preventing the entire cap 200 from entering into the cavity. Additionally, the exterior element 212 of the insulating cap is shaped so as to conform to, or emulate, the exterior of the linear lighting apparatus 100 so that element 212 of the end cap 200 appears to be an extension of the apparatus 100 (see FIG. 2 and FIG. 2H).

FIG. 2A also shows a first substantially cylindrical-shaped orifice 206 extending from the exterior side 212 of the cap to the interior side 211 of the cap. A conducting shaft 210 extends through the first orifice 206 and protruding from the exterior side 212 of the cap, such that the shaft 210 may rotate about its central axis within the first orifice 206. The portion 216 of the shaft 210 that enters the first orifice 206 has a diameter generally equal to the diameter of the first orifice 206, while portion 215 of the shaft 210 that protrudes from the cap has a diameter greater than the diameter of the first orifice 206, thereby preventing the portion 215 of the shaft from entering into the first orifice.

Note also that the end of the shaft 210 located within the first orifice 206 includes a lid 217, or cap, having a diameter greater than a portion of the shaft 216 leading up to the lid 217. The lid 217 includes an arrow shaped top with downward sloping sides to facilitate insertion of the shaft 210 into the orifice 206. The eave 223 underneath the lid 217 is used to hook or grab the portion 207 of element 208 that is inserted into the cap 201, as explained in greater detail below.

FIGS. 2A-2H also show a second orifice 218 extending perpendicularly through a portion 215 of the shaft 210 that protrudes from the cap, the second orifice 218 having a diameter adequate for accepting a conductive line. A static conductive element 208 located in the cap and in conductive contact with the shaft 210, wherein the conductive element 208 includes a portion 209 that protrudes from the interior side 211 of the cap so as to provide a conductive terminal for a lighting element, i.e., LED strip 150, located within the linear lighting apparatus 100.

In one embodiment, element 201 may be composed of an insulating material, such as rubber, plastic, a polymer, any combination of the above, or the like. Shaft 210 and element 208 may be composed of any electrically-conducting material, such as dielectric metal, copper, brass, gold, steel, or any combination of the above.

Figure 2B:
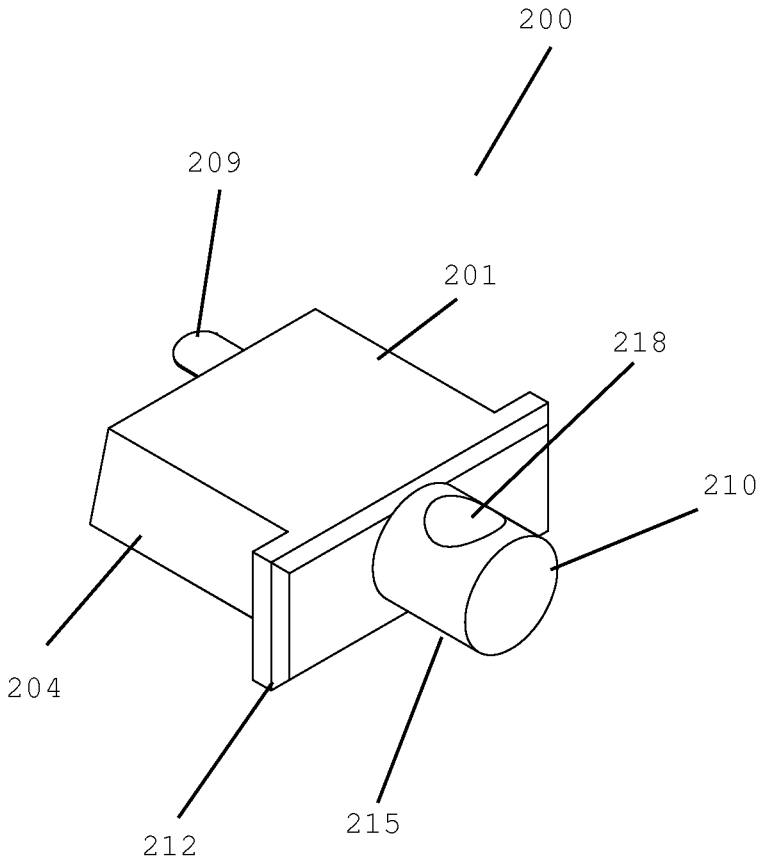
FIG. 2B shows a frontal perspective view of the first embodiment of the conductive end cap of FIG. 2A in an assembled state.
Figure 2C:
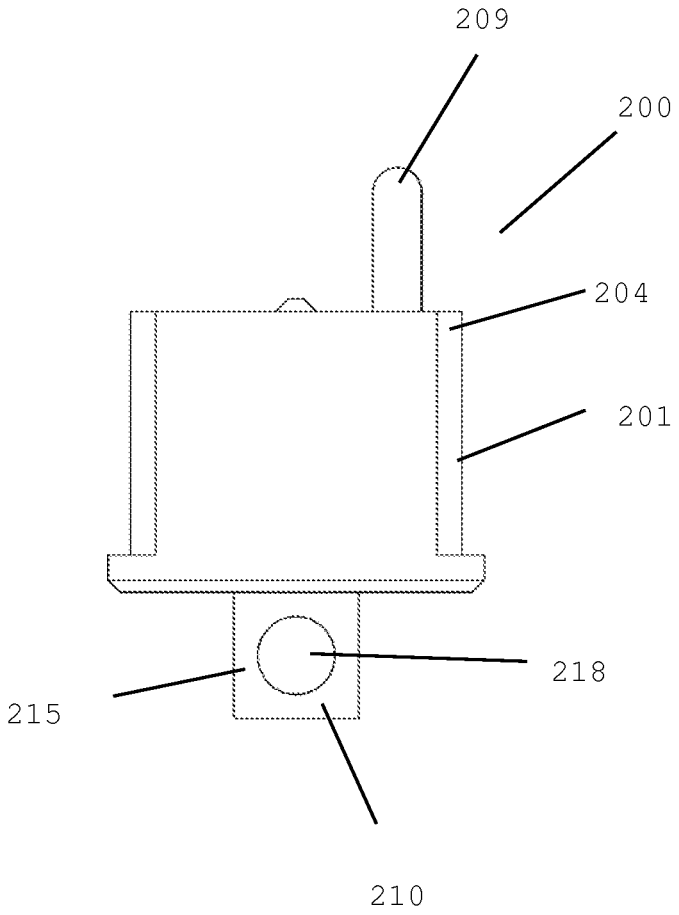
FIG. 2C shows a top view of the first embodiment of the conductive end cap of FIG. 2B.

FIG. 2B shows a frontal perspective view of the first embodiment of the conductive end cap 200 of FIG. 2A in an assembled state. FIG. 2C shows a top view of the first embodiment of the conductive end cap 200 of FIG. 2B.

Figure 2D:
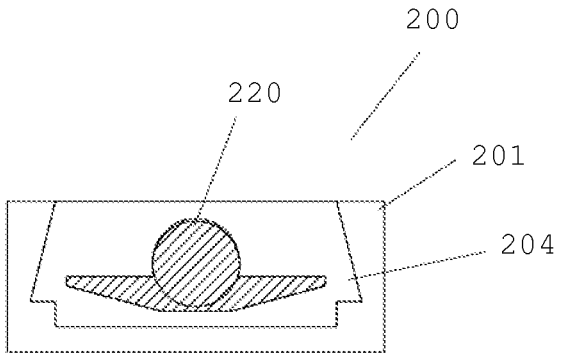
FIG. 2D shows a rear view of the first embodiment of the conductive end cap of FIG. 2A, detailing the cavity of end cap.
Figure 2E:
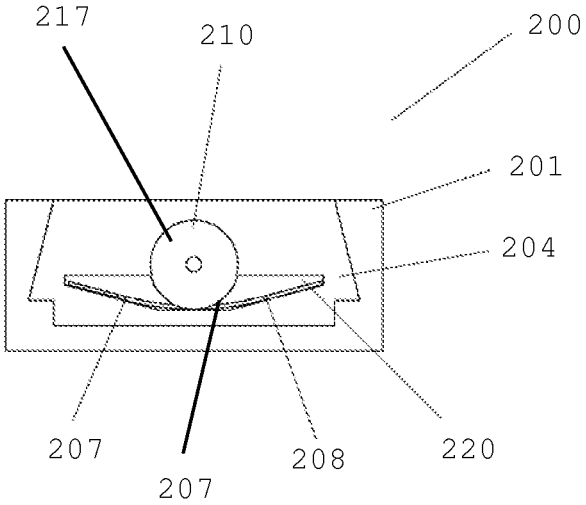
FIG. 2E shows a rear view of the first embodiment of the conductive end cap of FIG. 2B.

FIG. 2D shows a rear view of the first embodiment of the conductive end cap 200 of FIG. 2A, detailing the cavity 220 located in the rear of section 204 of end cap 200. Note the cavity 220 comprises two cavities conjoined together, including a circular-shaped portion of the cavity, below which a partially semi-circular shaped portion of the cavity is located. FIG. 2E shows a rear view of the first embodiment of the conductive end cap 200 of FIG. 2B. FIG. 2E shows the end cap 200 in an assembled stated with the shaft 210 inserted into the circular-shaped portion of the cavity 220, and the element 208 inserted into the semi-circular shaped portion of the cavity 220, such that shaft 210 is in conductive contact with element 208. Note the planar element 208 is bent to fit into the curved sidewall of the semi-circular shaped portion of the cavity 220. The planar element 208 is pushed towards the curved sidewall of the semi-circular shaped portion of the cavity 220 by the shaft 210. The planar element 208 may have elastic or shape-memory properties, such that when it is bent and pushed onto the curved sidewall of the semi-circular shaped portion of the cavity 220 by the shaft 210, it provides pressure back in the direction of the shaft.

Note that the lid 217 of the shaft 210 extends over the portion 207 of element 208 such that the portion 207 of element 208 is located under eave 223 of lid 217. This prevents the element 208 from travelling out of the cavity 220 as it is held in by shaft 210. Likewise, this arrangement prevents the shaft 210 from travelling out of the orifice 206 as it is held in by element 208.

Figure 2F:
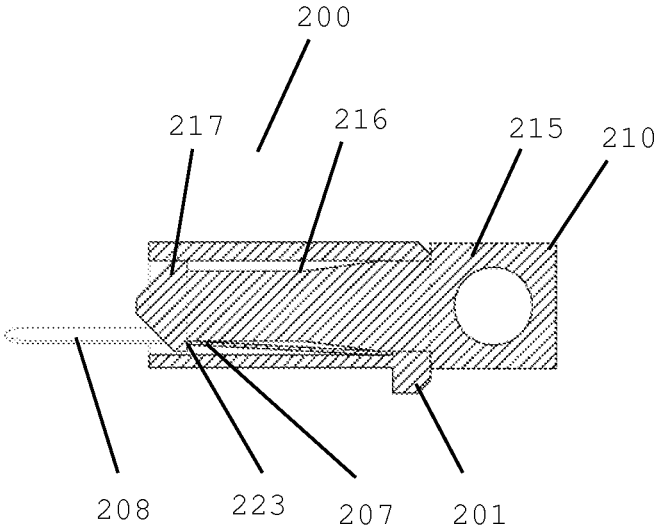
FIG. 2F shows a cross-sectional side view of the first embodiment of the conductive end cap of FIG. 2B.

FIG. 2F shows a cross-sectional side view of the first embodiment of the conductive end cap 200 of FIG. 2B. FIGS. 2E and 2F show that section 207 of static conductive element 208 provides pressure against the shaft 210 leading up to the lid 217 at a location under the eave 223 of the lid 217, such that the eave 223 of the lid 217 of the shaft 210 hooks or grabs the piece 207 of the static conductive element 208, thereby preventing the shaft 210 from being removed from the first orifice 206 in the direction of element 215. Note also that lid 217 includes an arrow shaped top with downward sloping sides to facilitate insertion of the shaft 210 into the orifice 206 while the element 207 is present within cap 210.

Figure 2G:
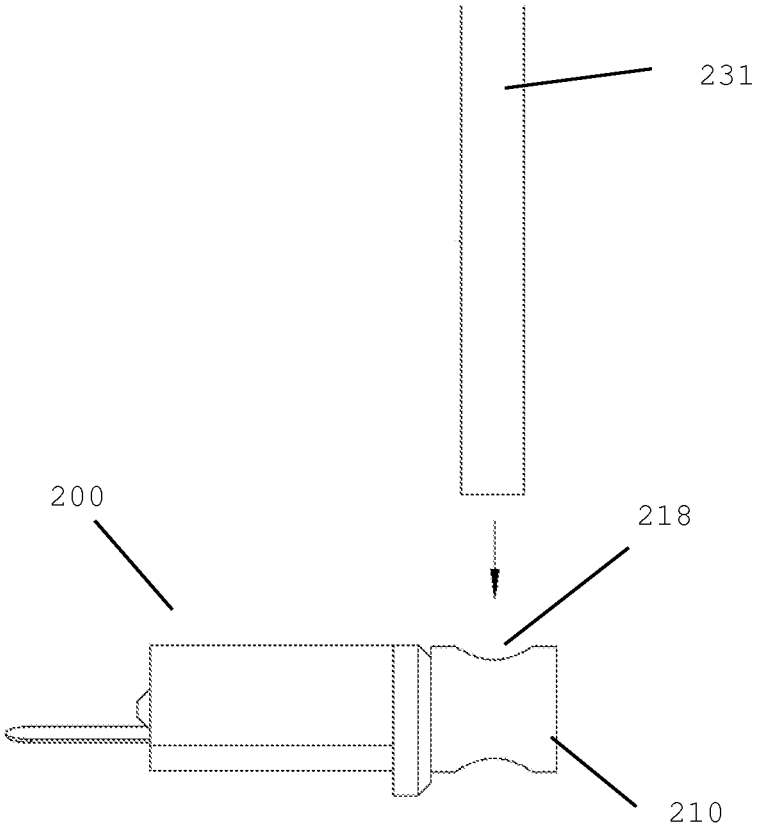
FIG. 2G shows a side view of the first embodiment of the conductive end cap of FIG. 2B, shown in relation to a conductive line.

FIG. 2G shows a side view of the first embodiment of the conductive end cap 200 of FIG. 2B, showing a conductive line 231, which may be a flexible or rigid rod, wire or cable, inserted into orifice 218 of shaft 210. The conductive line 231 provides a current that passes through the shaft 210, to the element 208, out the terminal 209 and eventually to an LED strip 150 located within the linear lighting apparatus 100.

Figure 2H:
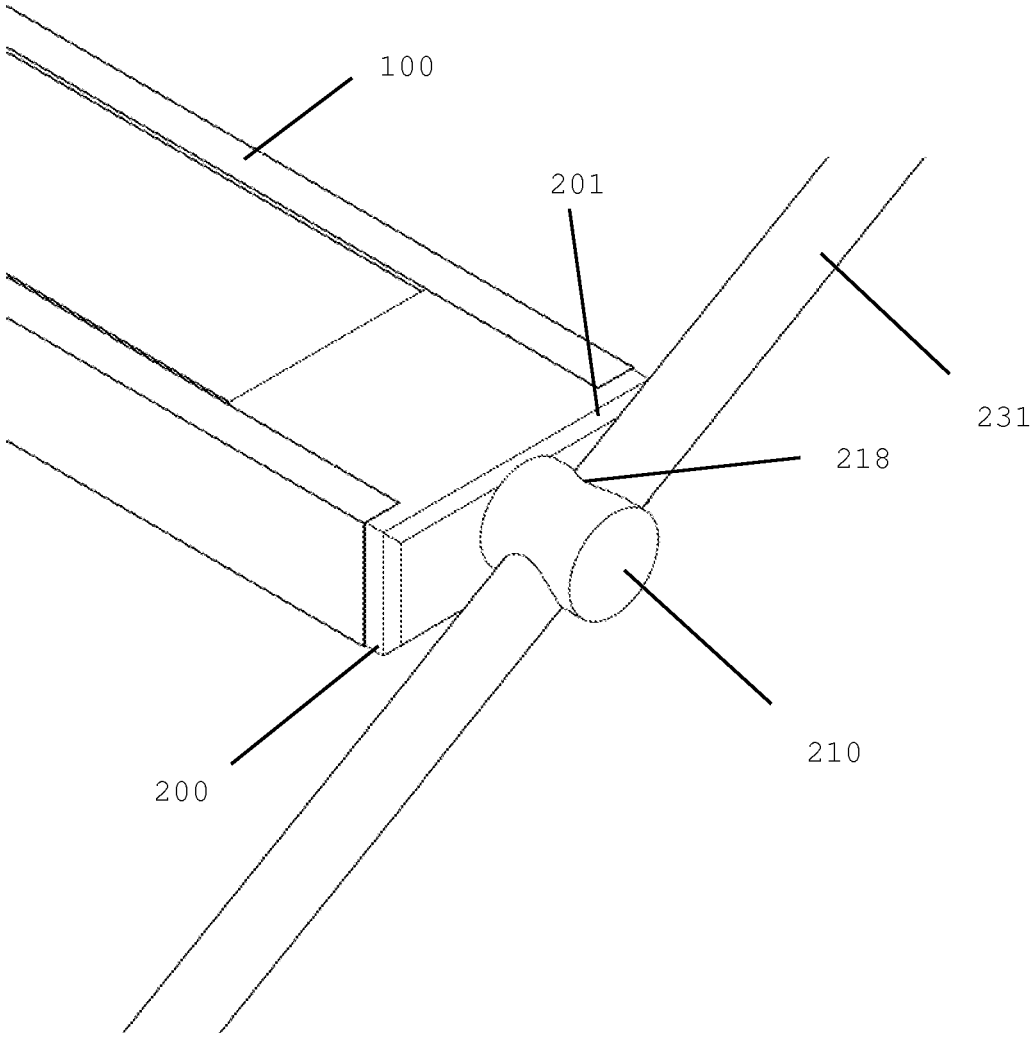
FIG. 2H shows a perspective view of the first embodiment of the conductive end cap of FIG. 2B, shown as a part of a linear lighting apparatus including a conductive line.

FIG. 2H shows a perspective view of the first embodiment of the conductive end cap 200 of FIG. 2B, shown as a part of a linear lighting apparatus 100 including a conductive line 231. FIG. 2H shows a conductive line 231, which may be a rigid rod, inserted into orifice 218 of shaft 210. Note the rotating swivel feature of the shaft 210 within the end cap 200 allows the line 231 and shaft 210 to remain stationary while allowing the cap 200 and linear lighting apparatus 100 to rotate 360 degrees or more about its main central axis.

Figure 2I:
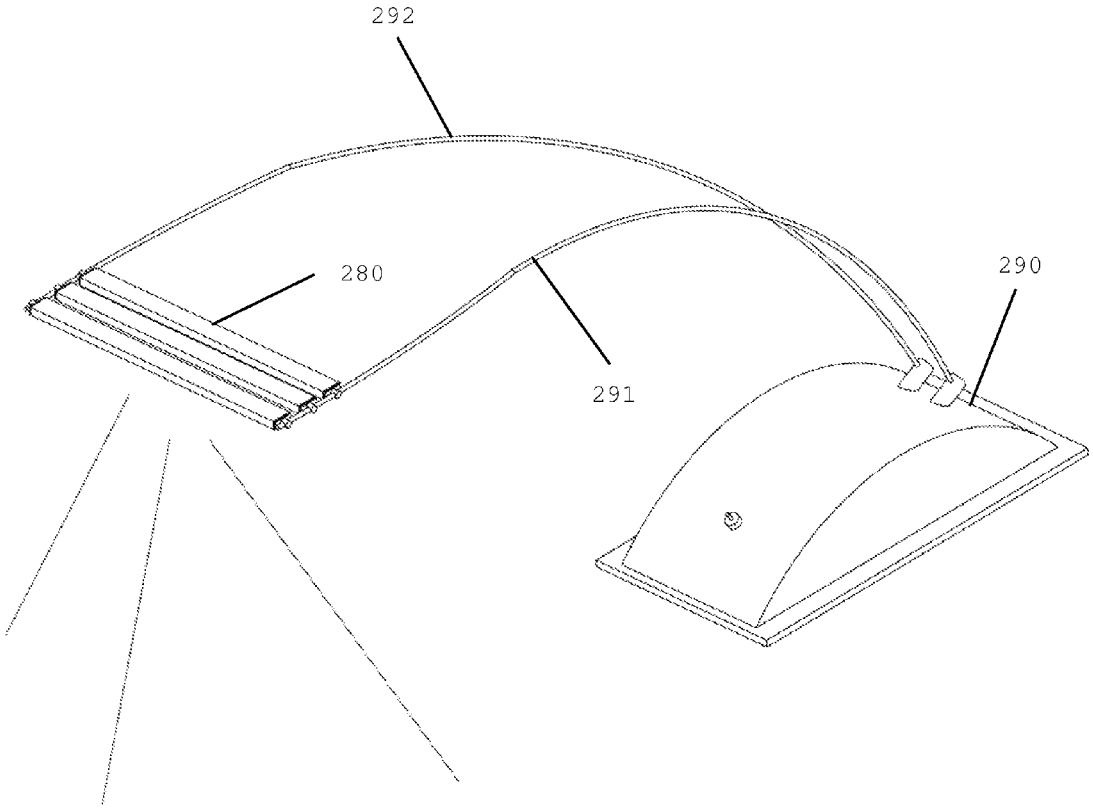
FIG. 2I shows a perspective view of a lamp implementation using multiple linear lighting apparatus that accept the conductive end cap of FIG. 2B, in accordance with one embodiment of the present invention.
Figure 2J:
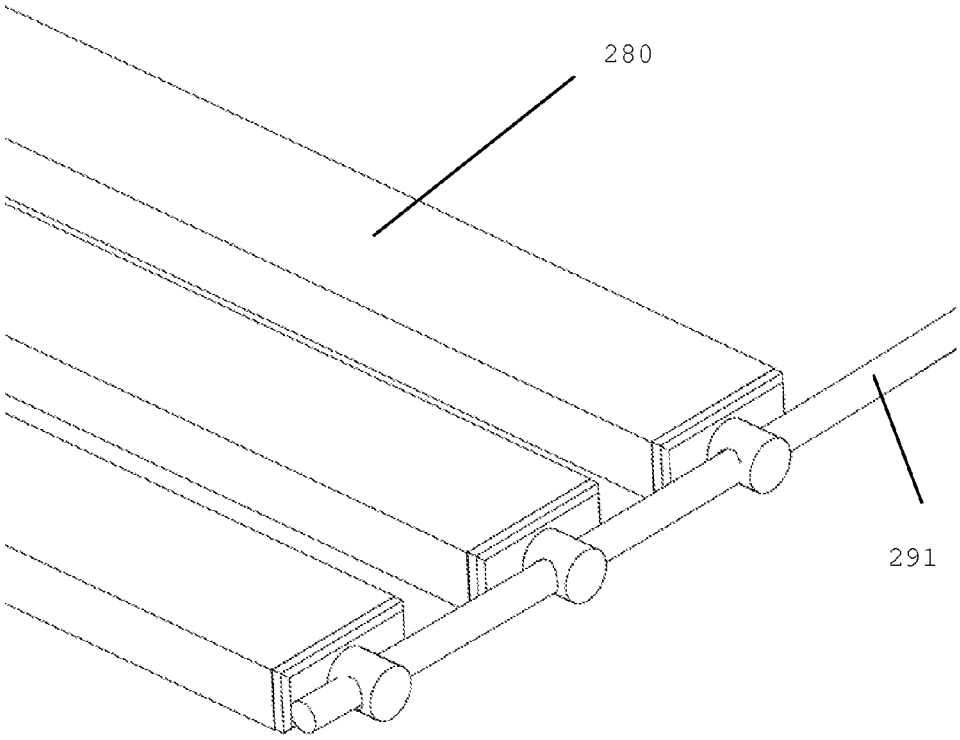
FIG. 2J shows a more detailed perspective view of one aspect of the lamp implementation of FIG. 2I.

FIG. 2I shows a perspective view of a lamp implementation 290 using multiple linear lighting apparatuses 280 that accept the conductive end cap of FIG. 2B, in accordance with one embodiment of the present invention. FIG. 2J shows a more detailed perspective view of one aspect of the lamp implementation 280 of FIG. 2I. FIGS. 2I and 2J show a lamp 290 that includes two conductive lines 291 and 292. Also included are three linear lighting apparatuses 280 comprising three elements of equal length, wherein the end cap on both sides of each linear lighting apparatus is equivalent to end cap 200 described above. Each line 291, 292 may be a rigid rod inserted into the orifice provided on the shaft protruding from each end cap. Line 291 provides a current originating at a power source at the base of the lamp 290, wherein the current travels to the linear lighting apparatuses 280, through their respective LED strips and back to the source of the lamp via line 292.

The rotating swivel feature of the shaft protruding from each end cap allows the lines 291, 292 and shafts to remain stationary while allowing each linear lighting apparatus 280 to rotate 360 degrees or more about its main central axis. This allows the light emanating from the linear lighting apparatuses 280 to be adjusted manually by the user according to his desires. This results in a lamp 290 with a high range of motion and easy maneuverability.

Figure 3A:
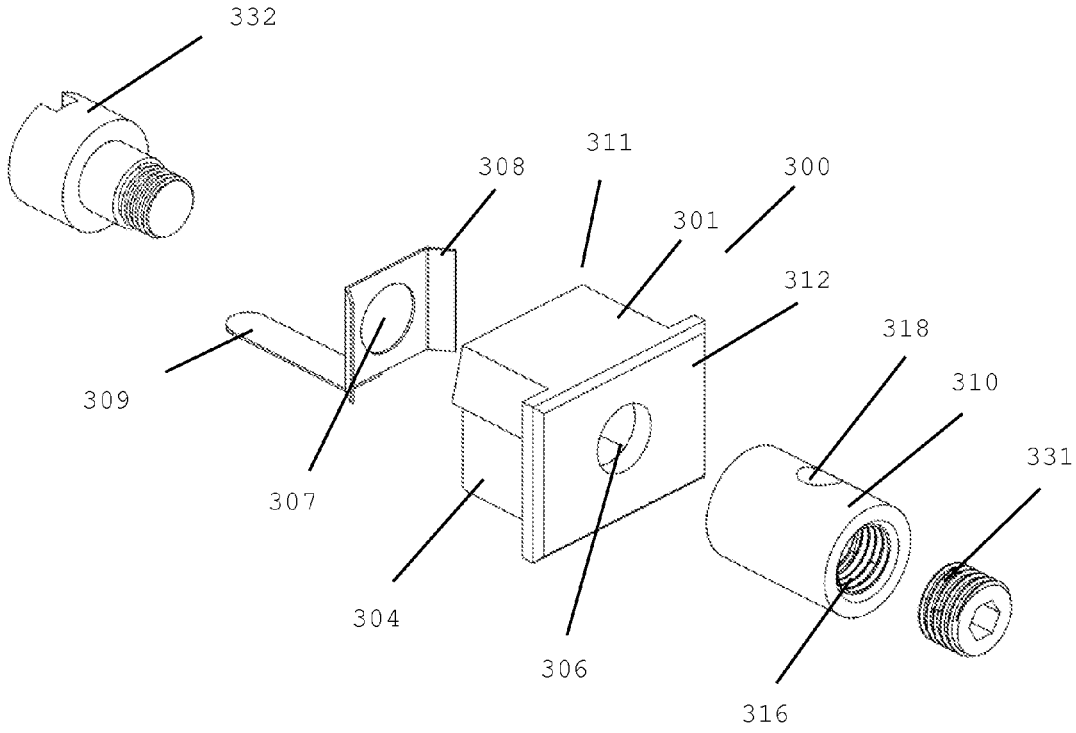
FIG. 3A shows a frontal perspective view of the second embodiment of the conductive end cap in a disassembled state, in accordance with one embodiment of the present invention.

A second embodiment of the present invention shall be described below with reference to FIGS. 3A-3F. FIG. 3A shows a frontal perspective view of the second embodiment of the conductive end cap 300, similar to end cap 200, in a disassembled state, in accordance with one embodiment of the present invention. FIGS. 3A-3D shows an insulating cap 301 for insertion into one end of a linear lighting apparatus, the cap 301 having an interior side 311 that faces an interior of the linear lighting apparatus and an exterior side 312 that remains exterior to the linear lighting apparatus. Note insulating cap 301 includes a portion 304 shaped to fit within a cavity in one end of the linear lighting apparatus and to provide a friction fit with an interior of the cavity. Also note that the exterior side 312 of the insulating cap is larger than the portion 304 and the cavity in one end of the linear lighting apparatus, thereby preventing the entire cap 300 from entering into the cavity.

FIG. 3A also shows a first substantially cylindrical-shaped orifice 306 extending from the exterior side 312 of the cap to the interior side 311 of the cap. A conducting tubular element 310, having a central, threaded bore 316, is placed adjacent to the first orifice 306 such that the opening at the rear of element 310 is adjacent to and concentric with the orifice 306. The diameter of bore 316 is generally equal to the diameter of the first orifice 306, while the outside diameter of element 310 is greater than the diameter of the first orifice 306, thereby preventing the element 310 from entering into the first orifice 306.

FIGS. 3A-3F also show a second orifice 318 extending perpendicularly through element 310, the second orifice 318 having a diameter adequate for accepting a conductive line. A first bolt 331 is threaded through the outward-facing end of bore 316 of tubular element 310 at least up to the second orifice 318, so as to create a friction fit (between bolts 331, 332) for a conductive line inserted into the second orifice 318. A static conductive element 308 is located at the rear of the cap 301, wherein the conductive element 308 includes a portion 309 that protrudes from the interior side 311 of the cap so as to provide a conductive terminal for a lighting element, i.e., LED strip 150, located within the linear lighting apparatus. The static conductive element 308 also includes a hole 307 having a diameter generally equal to the diameter of the first orifice 306.

FIGS. 3A-3D also show a threaded second bolt 332 extending through the hole 307 in the conductive element 308, through the first orifice 306 and threading through the backward-facing end of bore 316 of the tubular element 310, so as to conductively couple the conductive element 308 and the tubular element 310. Note that element 310 may rotate about its central axis due to its threaded connection to bolt 332 and the cylindrical nature of orifice 306.

Figure 3B:
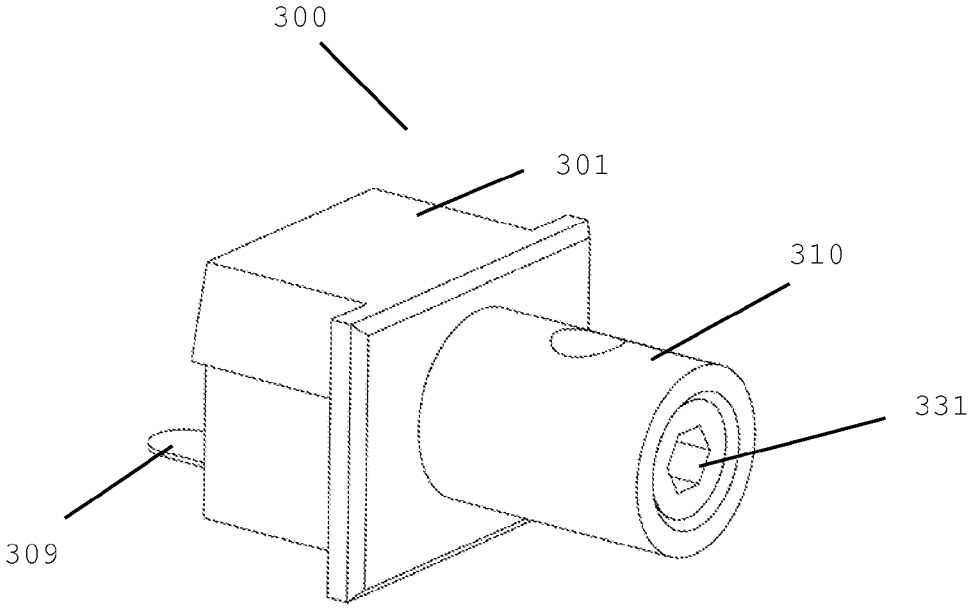
FIG. 3B shows a frontal perspective view of the second embodiment of the conductive end cap of FIG. 3A in an assembled state.
Figure 3C:
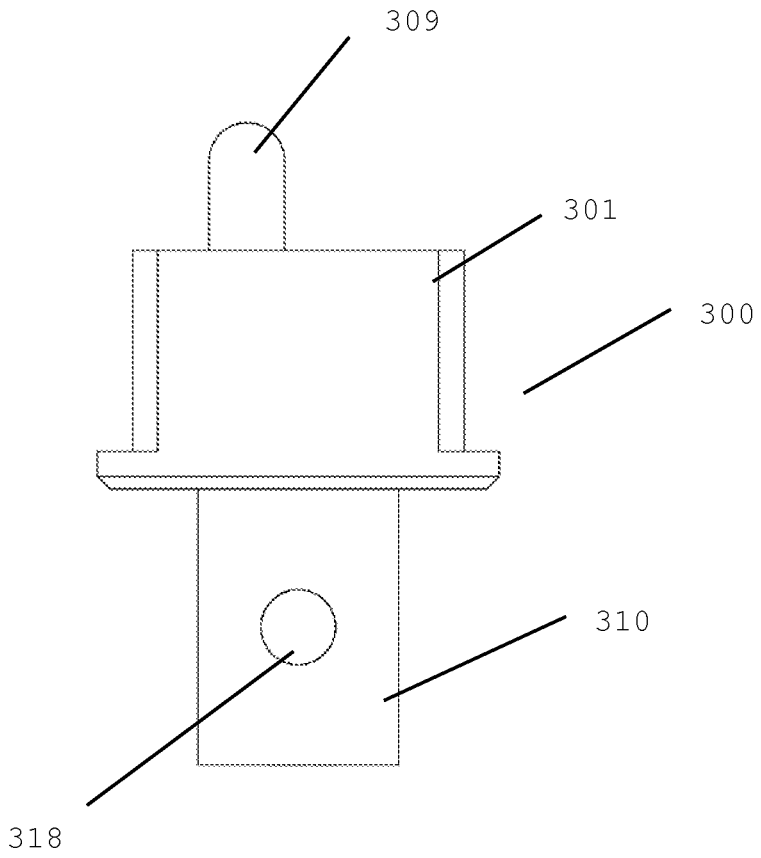
FIG. 3C shows a top view of the second embodiment of the conductive end cap of FIG. 3B.

FIG. 3B shows a frontal perspective view of the second embodiment of the conductive end cap 300 of FIG. 3A in an assembled state. FIG. 3C shows a top view of the second embodiment of the conductive end cap 300 of FIG. 3B.

Figure 3D:
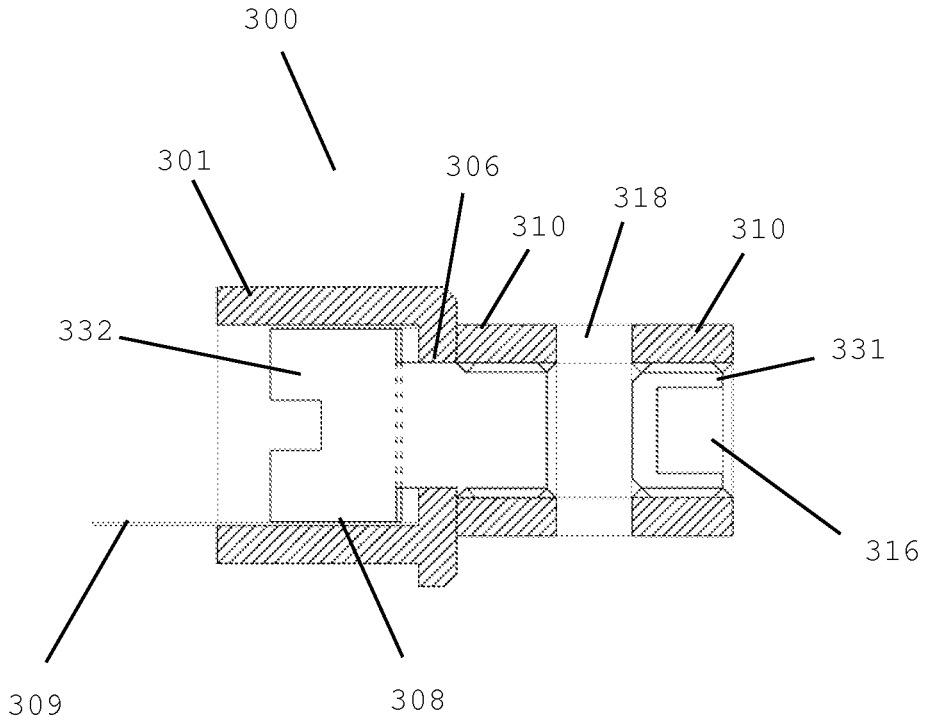
FIG. 3D shows a cross-sectional side view of the second embodiment of the conductive end cap of FIG. 3B.

FIG. 3D shows a cross-sectional side view of the second embodiment of the conductive end cap 300 of FIG. 3B. FIG. 3D shows the threaded second bolt 332 extending through the hole 307 in the conductive element 308, through the first orifice 306 and threading through the backward-facing end of bore 316 of the tubular element 310, so as to conductively couple the conductive element 308 and the tubular element 310. Second orifice 318 extends perpendicularly through element 310 and accepting a conductive line. A first bolt 331 is threaded through the outward-facing end of bore 316 of tubular element 310 at least up to the second orifice 318, so as to create a friction fit (between bolts 331, 332) for the conductive line inserted into 318. Static conductive element 308 includes a portion 309 that protrudes from the interior side 311 of the cap.

Figure 3E:
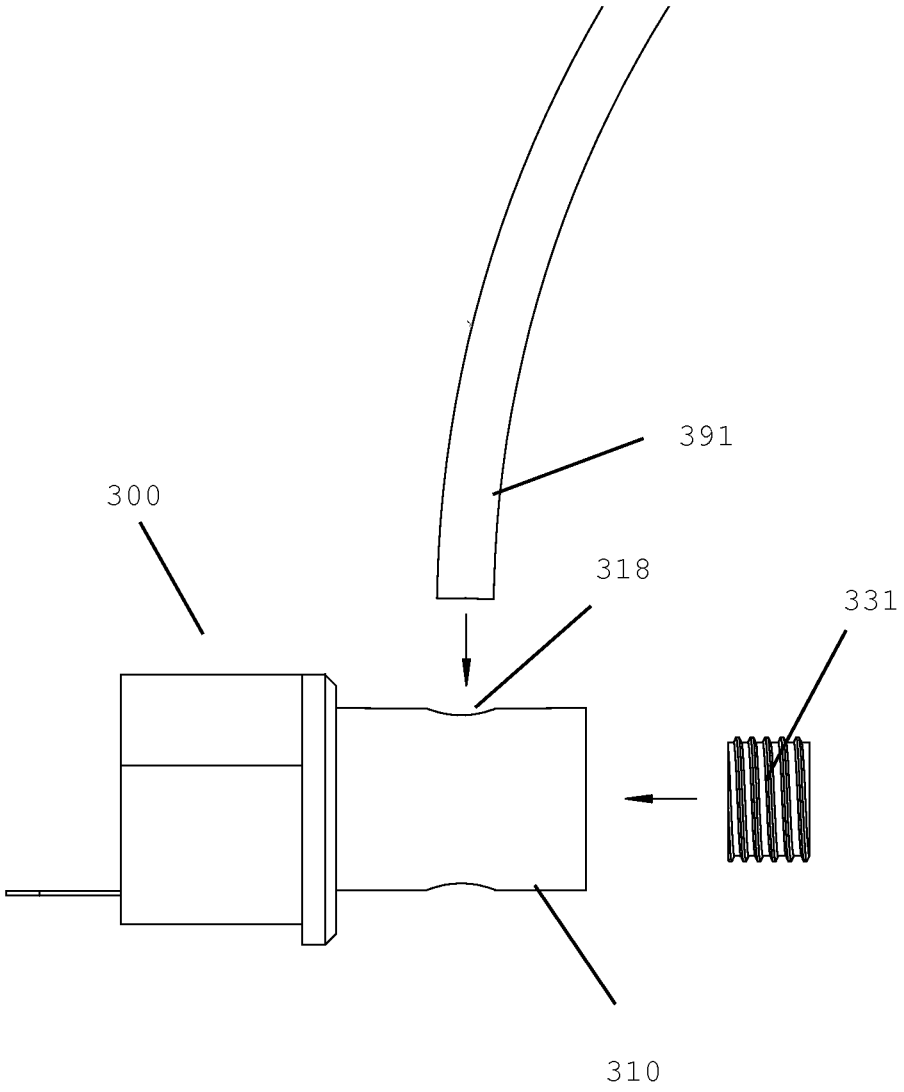
FIG. 3E shows a side view of the second embodiment of the conductive end cap of FIG. 3B, shown in relation to a conductive line.

FIG. 3E shows a side view of the second embodiment of the conductive end cap 300 of FIG. 3B, shown in relation to a conductive line 391, which may be a flexible or rigid rod, wire or cable, inserted into orifice 318 of shaft 310. The line 391 is secured to the apparatus 300 by inserting bolt 331 which provide a friction fit that squeezes line 391 between bolts 331 and 332. The conductive line 391 provides a current that passes through the shaft 310, through bolt 332, to the element 308, out the terminal 309 and eventually to an LED strip located within a linear lighting apparatus.

Figure 3F:
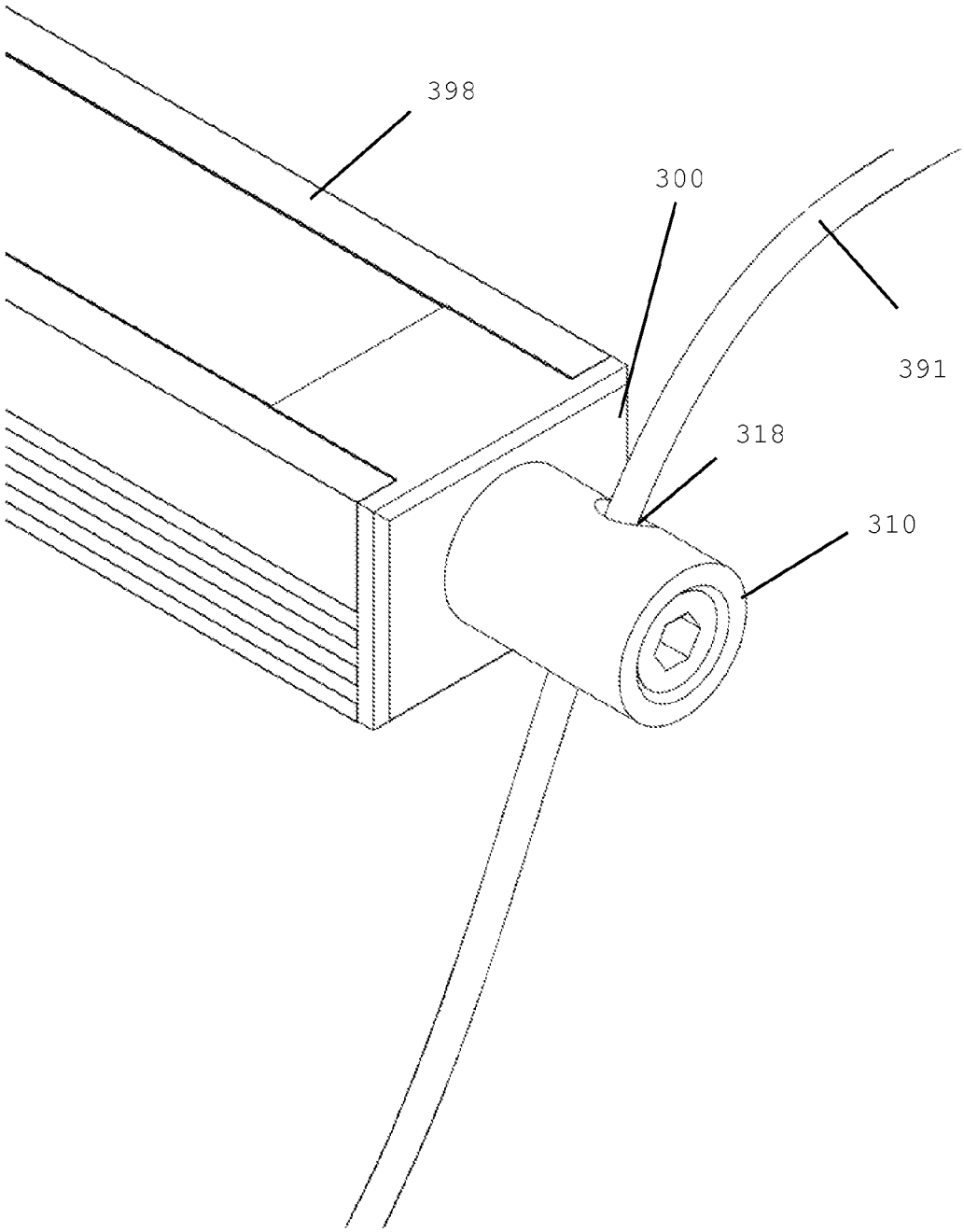
FIG. 3F shows a perspective view of the second embodiment of the conductive end cap of FIG. 3B, shown as a part of a linear lighting apparatus including a flexible conductive line.

FIG. 3F shows a perspective view of the second embodiment of The conductive end cap 300 of FIG. 3B, shown as a part of a linear lighting apparatus 398 including a flexible conductive line 391. FIG. 3F shows a conductive line 391, which may be a rigid rod, inserted into orifice 318 of shaft 310. Note the rotating swivel feature of the shaft 310 within the end cap 300 allows the line 391 and shaft 310 to remain stationary while allowing the cap 300 and linear lighting apparatus 398 to rotate 360 degrees or more about its main central axis.

Figure 4A:
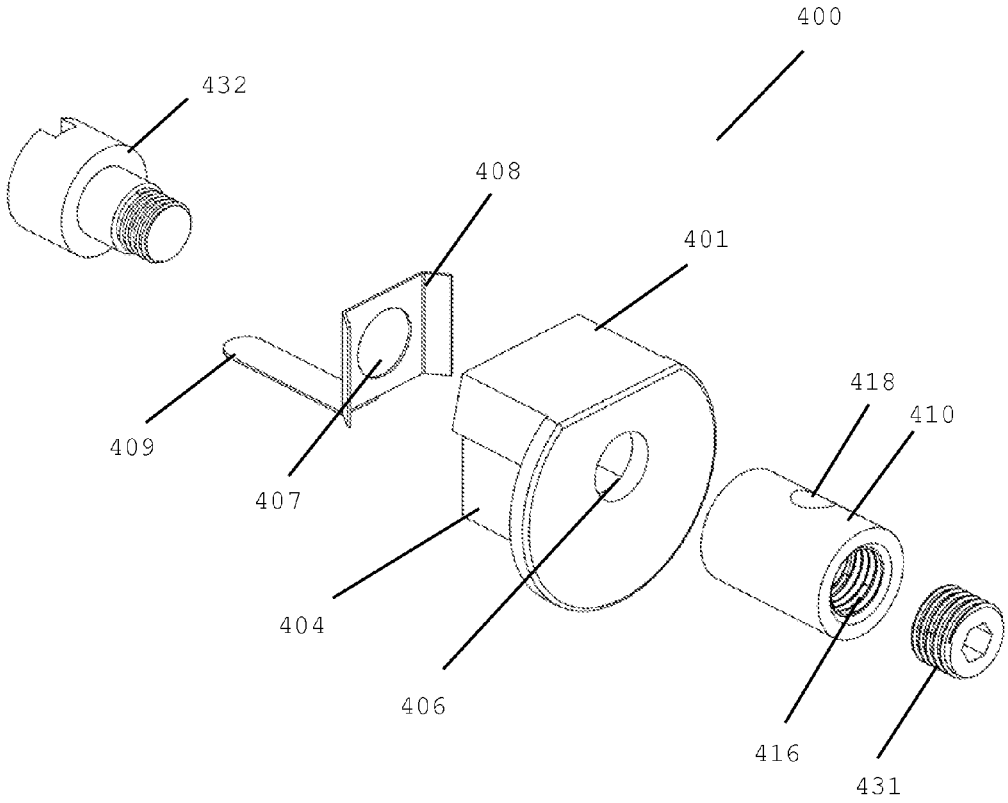
FIG. 4A shows a frontal perspective view of the third embodiment of the conductive end cap in a disassembled state, in accordance with one embodiment of the present invention.
Figure 4B:
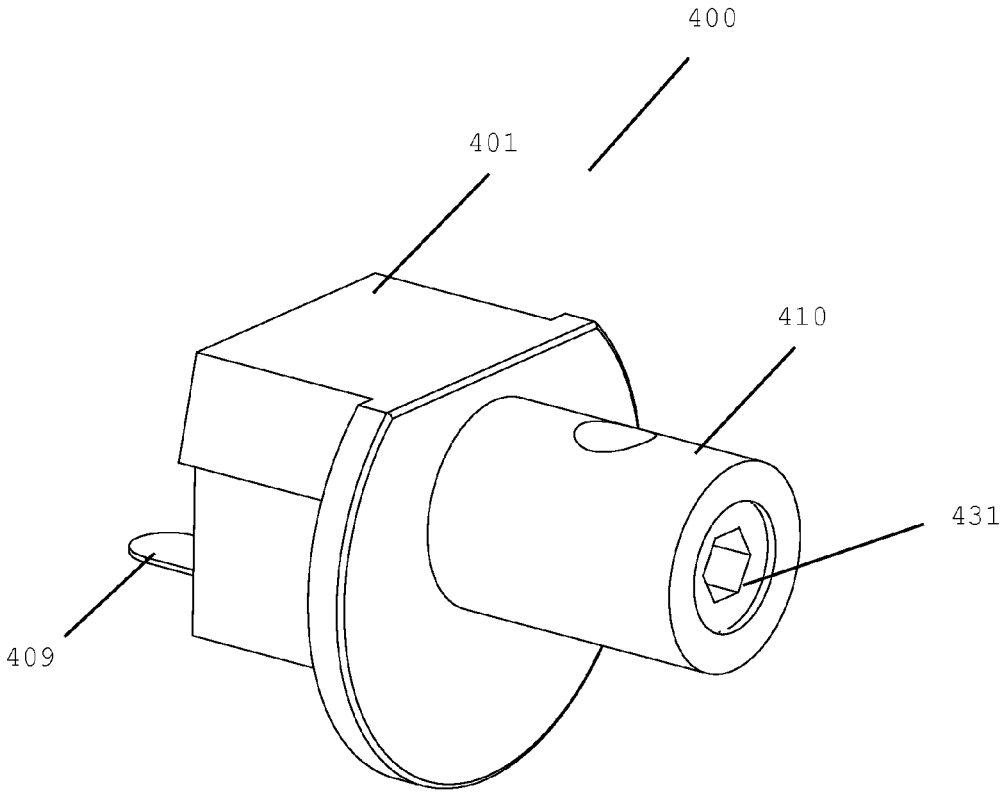
FIG. 4B shows a frontal perspective view of the third embodiment of the conductive end cap of FIG. 4A in an assembled state.
Figure 4C:
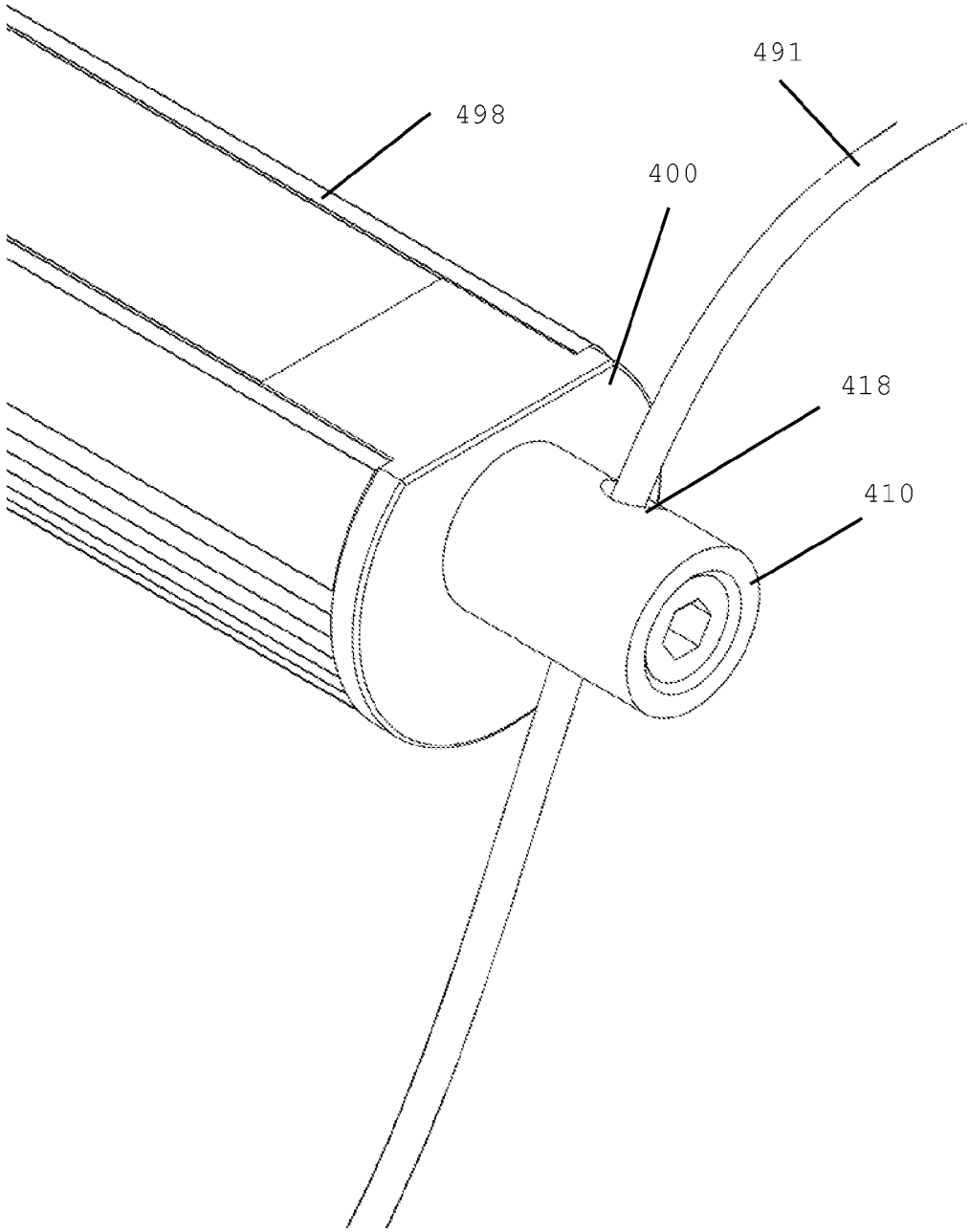
FIG. 4C shows a perspective view of the third embodiment of the conductive end cap of FIG. 4B, shown as a part of a linear lighting apparatus including a flexible conductive line.

A second embodiment of the present invention shall be described below with reference to FIGS. 4A-4C. FIG. 4A shows a frontal perspective view of the third embodiment of the conductive end cap 400, similar to end cap 300, in a disassembled state, in accordance with one embodiment of the present invention. FIGS. 4A-4C show an insulating cap 401 for insertion into one end of a linear lighting apparatus. Note insulating cap 401 includes a portion 404 shaped to fit within a cavity in one end of the linear lighting apparatus. FIG. 4A also shows a first substantially cylindrical-shaped orifice 406 extending through the cap. A conducting tubular element 410, having a central, threaded bore 416, is placed adjacent to the first orifice 406. FIGS. 4A-4C also show a second orifice 418 extending perpendicularly through element 410, the second orifice 418 having a diameter adequate for accepting a conductive line. A first bolt 431 is threaded through the outward-facing end of bore 416 of tubular element 410 at least up to the second orifice 418, so as to create a friction fit (between bolts 431, 432) for a conductive line inserted into the second orifice 418.

A static conductive element 408 is located at the rear of the cap 401, wherein the conductive element 408 includes a portion 409 that protrudes from the interior side of the cap so as to provide a conductive terminal for a lighting element, i.e., an LED strip, located within the linear lighting apparatus. The static conductive element 408 also includes a hole 407. FIGS. 4A-4C also show a threaded second bolt 432 extending through the hole 407 in the conductive element 408, through the first orifice 406 and threading through the backward-facing end of bore 416 of the tubular element 410, so as to conductively couple the conductive element 408 and the tubular element 410. Note that element 410 may rotate about its central axis due to its threaded connection to bolt 432.

FIG. 4B shows a frontal perspective view of the third embodiment of the conductive end cap of FIG. 4A in an assembled state. FIG. 4C shows a perspective view of the third embodiment of the conductive end cap of FIG. 4B, shown as a part of a linear lighting apparatus 498 including a flexible conductive line 491. FIG. 4C shows a conductive line 491, which may be a flexible wire, inserted into orifice 418 of shaft 410. Note the rotating swivel feature of the shaft 410 in relation to the end cap 400 allows the line 491 and shaft 410 to remain stationary while allowing the cap 400 and linear lighting apparatus 498 to rotate 360 degrees or more about its main central axis.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

I claim:

1. A conductive end cap for a linear lighting apparatus, comprising:

an insulating cap for one end of the linear lighting apparatus, the cap having an interior side that faces an interior of the linear lighting apparatus and an exterior side that remains exterior to the linear lighting apparatus;

a first orifice extending from the exterior side of the cap to the interior side of the cap;

a conducting shaft extending through the first orifice and protruding from the exterior side of the cap, such that the shaft may rotate about its central axis within the first orifice;

a second orifice extending perpendicularly through a portion of the shaft that protrudes from the cap, the second orifice having a diameter adequate for accepting a conductive line; and a static conductive element located in the cap and in conductive contact with the shaft, wherein the conductive element includes a portion that protrudes from the interior side of the cap so as to provide a conductive terminal for a lighting element located within the linear lighting apparatus.

2. The conductive end cap of claim 1, wherein the insulating cap includes a portion shaped to fit within a cavity in one end of the linear lighting apparatus and to provide a friction fit with an interior of the cavity.

3. The conductive end cap of claim 2, wherein the exterior side of the insulating cap is larger than the cavity in one end of the linear lighting apparatus, thereby preventing the entire cap from entering into the cavity.

4. The conductive end cap of claim 3, wherein the portion of the shaft that protrudes from the cap has a diameter greater than the first orifice, thereby preventing the portion of the shaft from entering into the first orifice.

5. The conductive end cap of claim 4, wherein an end of the shaft located within the first orifice includes a lid having a diameter greater than a portion of the shaft leading up to the lid.

6. The conductive end cap of claim 5, wherein the static conductive element provides pressure against the shaft leading up to the lid at a location under an eave of the lid, thereby preventing the shaft from being removed from the first orifice.

7. A conductive end cap for a linear lighting apparatus, comprising:

an insulating cap for one end of the linear lighting apparatus, the cap having an interior side that faces an interior of the linear lighting apparatus and an exterior side that remains exterior to the linear lighting apparatus;

a first orifice extending from the exterior side of the cap to the interior side of the cap;

a conducting tubular element located on the exterior side of the cap, the tubular element having a first end placed adjacent to the first orifice and a second end, wherein an interior surface of the tubular element is threaded to accept a threaded bolt;

a second orifice extending perpendicularly through the tubular element, the second orifice having a diameter adequate for accepting a conductive line;

a first bolt threaded through the second end of the tubular element at least up to the second orifice, so as to create a friction fit for the conductive line in the second orifice of the tubular element and;

a conductive element located on the interior side of the cap and having a hole placed adjacent to the first orifice in the interior side of the cap, wherein the conductive element includes a portion that protrudes from the interior side of the cap so as to provide a conductive terminal for a lighting element located within the linear lighting apparatus; and a second bolt extending through the hole in the conductive element, through the first orifice and threading through the first end of the tubular element, so as to conductively couple the conductive element and the tubular element.

8. The conductive end cap of claim 7, wherein the insulating cap includes a portion shaped to fit within a cavity in one end of the linear lighting apparatus and to provide a friction fit with an interior of the cavity.

9. The conductive end cap of claim 8, wherein the exterior side of the insulating cap is larger than the cavity in one end of the linear lighting apparatus, thereby preventing the entire cap from entering into the cavity.

10. The conductive end cap of claim 9, wherein the tubular element has a diameter greater than the first orifice, thereby preventing the tubular element from entering into the first orifice.

11. The conductive end cap of claim 10, wherein the conductive element comprises a substantially planar element having a hole placed adjacent to the first orifice in the interior side of the cap, and a second planar element extending perpendicularly from the first planar element towards an interior of the linear lighting apparatus, wherein the second planar element comprises the conductive terminal.

12. The conductive end cap of claim 11, wherein a portion of the second bolt has a diameter greater than the hold in the conductive element, thereby preventing the portion of the second bolt from entering into the hole.

13. A linear lighting apparatus, comprising:

an elongated element having a substantially U-shaped cross-section comprising a first vertical sidewall, a second vertical sidewall and a horizontal floor joining the first and second sidewalls;

an LED strip placed longitudinally along the horizontal floor of the elongated element;

an optical element comprising a strip for placement on top of the elongated element;

an insulating cap for one end of the elongated element, the cap having an interior side that faces an interior of the elongated element and an exterior side that remains exterior to the elongated element;

a first orifice extending from the exterior side of the cap to the interior side of the cap;

a conducting tubular element located on the exterior side of the cap, the tubular element having a first end placed adjacent to the first orifice and a second end, wherein an interior surface of the tubular element is threaded to accept a threaded bolt;

a second orifice extending perpendicularly through the tubular element, the second orifice having a diameter adequate for accepting a conductive line;

a first bolt threaded through the second end of the tubular element at least up to the second orifice, so as to create a friction fit for the conductive line in the second orifice of the tubular element and;

a conductive element located on the interior side of the cap and having a hole placed adjacent to the first orifice in the interior side of the cap, wherein the conductive element includes a portion that protrudes from the interior side of the cap so as to provide a conductive terminal coupled with the LED strip; and a second bolt extending through the hole in the conductive element, through the first orifice and threading through the first end of the tubular element, so as to conductively couple the conductive element and the tubular element.

14. The linear lighting apparatus of claim 13, wherein the insulating cap includes a portion shaped to fit within a cavity in one end of the elongated element and to provide a friction fit with an interior of the cavity.

15. The linear lighting apparatus of claim 14, wherein the exterior side of the insulating cap is larger than the cavity in one end of the elongated element, thereby preventing the entire cap from entering into the cavity.

16. The linear lighting apparatus of claim 15, wherein the tubular element has a diameter greater than the first orifice, thereby preventing the tubular element from entering into the first orifice.

17. The linear lighting apparatus of claim 16, wherein the conductive element comprises a substantially planar element having a hole placed adjacent to the first orifice in the interior side of the cap, and a second planar element extending perpendicularly from the first planar element towards an interior of the elongated element, wherein the second planar element comprises the conductive terminal.

18. The linear lighting apparatus of claim 17, wherein a portion of the second bolt has a diameter greater than the hold in the conductive element, thereby preventing the portion of the second bolt from entering into the hole.

* * * * *